US006272797B1

(12) United States Patent
Finger

(10) Patent No.: US 6,272,797 B1
(45) Date of Patent: Aug. 14, 2001

(54) TRIM SECUREMENT SYSTEM

(76) Inventor: Fred Finger, 106 Defiance Rd., apt. #2, Malaga, NJ (US) 08328

( * ) Notice: Subject to any disclaimer, the term of this patent is extended or adjusted under 35 U.S.C. 154(b) by 0 days.

(21) Appl. No.: 09/489,995

(22) Filed: Jan. 21, 2000

(51) Int. Cl.[7] ..... E64B 7/00

(52) U.S. Cl. ..... 52/94; 52/58; 52/60; 52/96; 52/718.01; 52/748.1

(58) Field of Search ..... 52/94, 58, 59, 52/60, 96, 748.1

(56) References Cited

U.S. PATENT DOCUMENTS 4,300,319 * 11/1981 Frost et al. ..... 52/11
4,339,898 * 7/1982 Pichette ..... 52/94
5,836,113 * 11/1998 Bachman ..... 52/94
6,026,616 * 2/2000 Gibson ..... 52/95
6,138,418 * 10/2000 Dyer et al. ..... 52/94

* cited by examiner

*Primary Examiner*—Carl D. Friedman
*Assistant Examiner*—Steve Varner
(74) *Attorney, Agent, or Firm*—Goldstein Law Offices P.C

(57) ABSTRACT

A trim securement system, for use on a building having a roof, siding, a rake board between the roof and the siding, and a rake-board J-channel located immediately below the rake board. A receiver molding is mounted between the rake board and roofing tiles. A trim device includes a front trim surface, upper and lower trim surfaces which extend perpendicularly rearward from the front trim surface, and a trim tab which extends perpendicularly upward from the lower trim surface. The trim device is mounted so that the front trim surface covers the rake board, the upper trim surface extends into the receiver molding, and the trim tab extends into the J-channel.

4 Claims, 2 Drawing Sheets

TRIM SECUREMENT SYSTEM

BACKGROUND OF THE INVENTION

The invention relates to a trim securement system. More particularly, the invention relates to a system for securing fascia trim at the roof-line of a building, and for concealing the J-channel commonly present immediately beneath the fascia in buildings sided with aluminum or vinyl siding.

Fascia or facing panels form a portion of the overall waterproofing system of a house. It is standardly affixed to the wooden rake board at the roof-line with roofing nails. However, because of shrinkage of the wood with time and arying humidity conditions, the facing panels have a tendency to buckle. Even a slight buckling will cause the ascia to have a wavy appearance. Further, even the nails themselves detract from an otherwise seamless appearance of the fascia.

Aluminum or vinyl sided homes employ so called "J-channels" to hold the siding in place. The J-channels are mounted vertically and horizontally, and frame the siding boards on all sides. Put another way, the siding boards are tucked under the J-channels to hold said siding boards in place. Although necessary for mounting the aluminum or vinyl siding, the J-channels break up and ruin an appearance which would otherwise resemble old style clapboard sided buildings.

While these units may be suitable for the particular purpose employed, or for general use, they would not be as suitable for the purposes of the present invention as disclosed hereafter.

SUMMARY OF THE INVENTION

It is an object of the invention to produce a system for providing a seamless appearance at the roofline of aluminum or vinyl clad buildings. Accordingly a system is provided which covers both the facing boards and the J-channel of such buildings.

It is another object of the invention to provide a system which eliminates the necessity for fastening nails to penetrate through the facing in order to secure the facing to the rake board. Accordingly, the trim device of the present invention fastens above the rake board under the roofing, and secures below the rake board in the J-channel.

It is a further object of the invention to provide a system which effectively conceals the J-channel. Accordingly, the trim device extends downward from the rake board, over the J-channel, and then attaches in the J-channel.

The invention is a trim securement system, for use on a building having a roof, siding, a rake board between the roof and the siding, and a rake-board J-channel located immediately below the rake board. A receiver molding is mounted between the rake board and roofing tiles. A trim device includes a front trim surface, upper and lower trim surfaces which extend perpendicularly rearward from the front trim surface, and a trim tab which extends perpendicularly upward from the lower trim surface. The trim device is mounted so that the front trim surface covers the rake board, the upper trim surface extends into the receiver molding, and the trim tab extends into the J-channel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
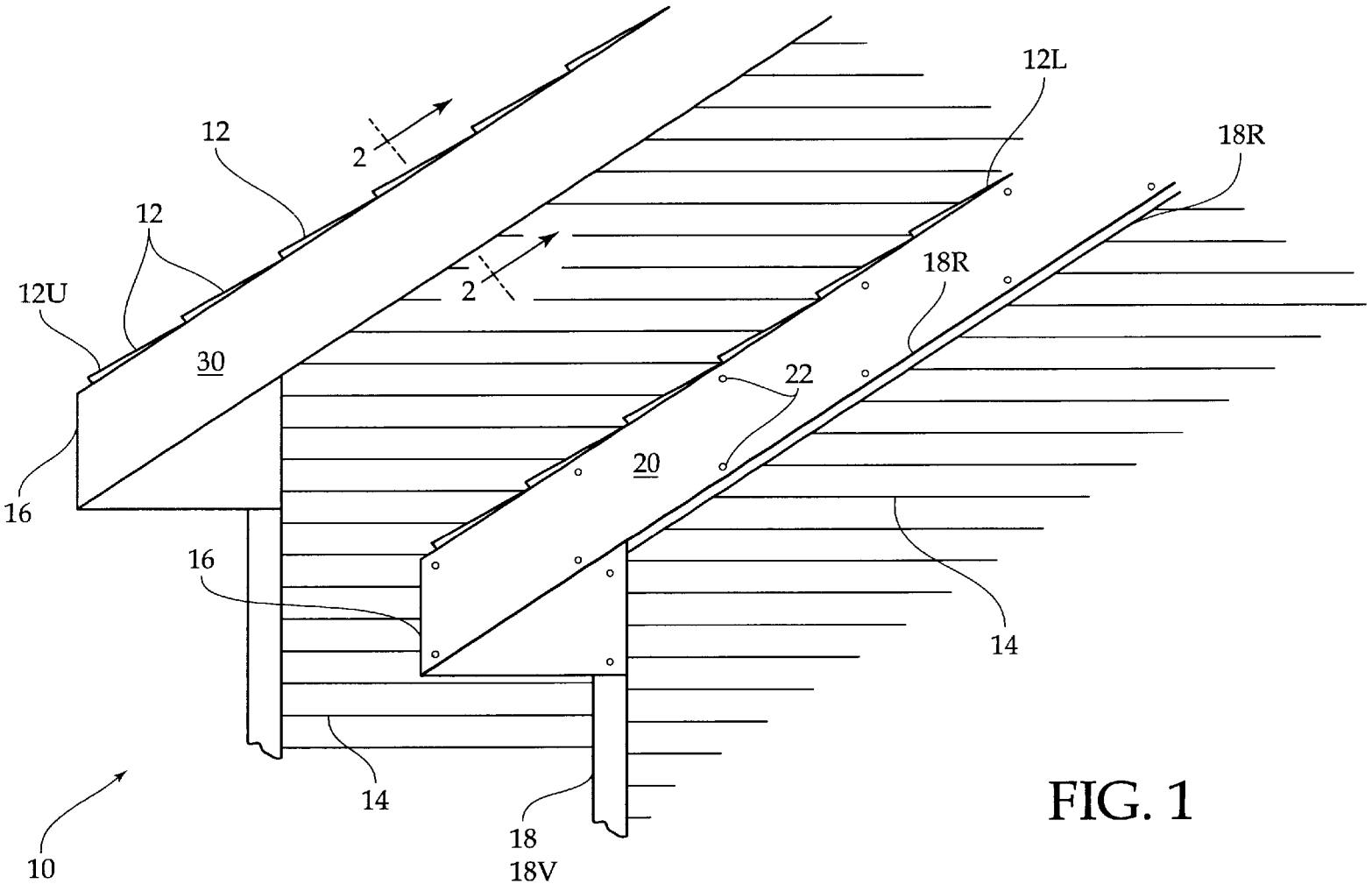
FIG. 1 is a side elevational view of a house having two roof levels, wherein conventional fascia is attached at the lower roof, while the trim device of the present invention is attached at the upper roof.

FIG. 1 illustrates a building 10 having at least one roof 12, and having siding 14. The roof 12 comprises roofing tiles 12T. The roofs 12 in FIG. 1 may be classified as an upper roof 12U and a lower roof 12L. A rake board 16 is located immediately below each roof 12, and is immediately above siding 14.

FIG. 1 illustrates a standard trim installation at the lower roof 12L. The siding 14 has been affixed to the building 10 using several J-channels 18. The J-channels 18 include vertical J-channels 18V and rake-board J-channels 18R which extend immediately below the rake board 16. Fascia trim 20 has been attached to the rake board 16 with one or more rows of nails 22. The rake-board J-channel 18R below the lower roof 12L is exposed.

Referring now to the upper roof 12L, a trim device 30 has been affixed to the building 10 wherein the rake board 16 and the rake-board J-channel 18R (not visible) are covered with a single continuous piece. No nails are used to attach the trim device 30 to the rake board 16. Accordingly, the trim device 30 provides a seamless appearance between the roof 12U and the siding 14 therebelow.

Figure 3:
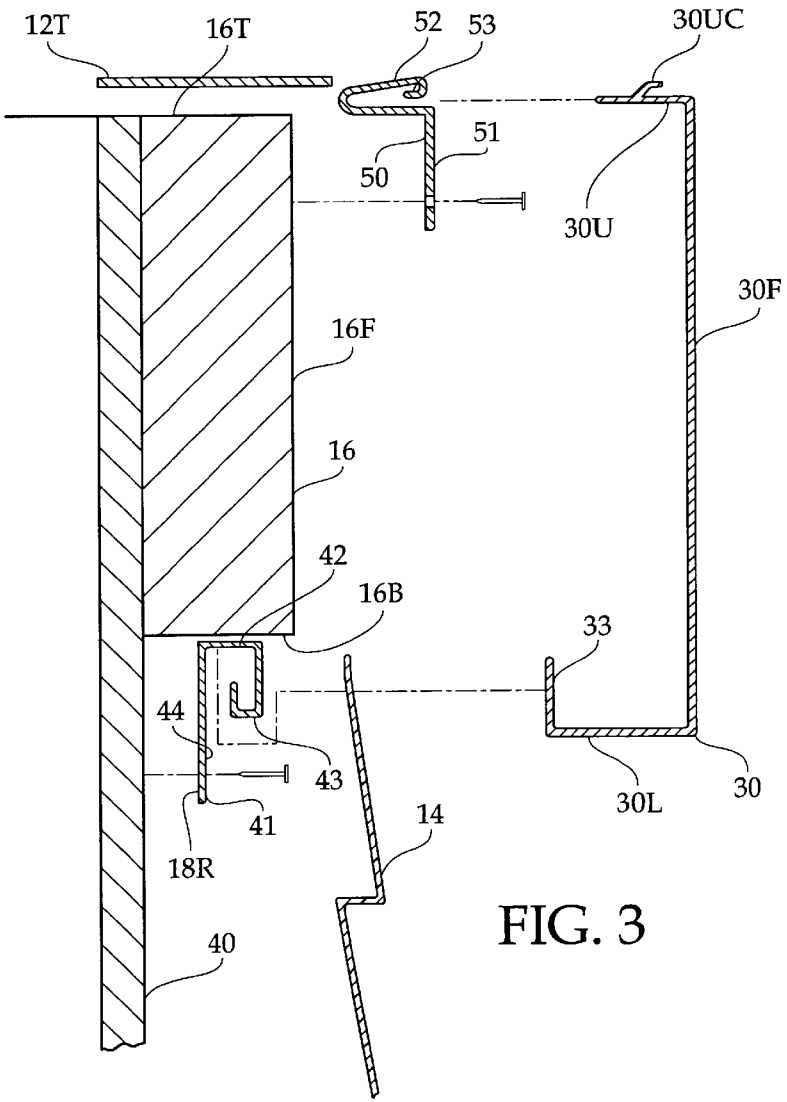
FIG. 3 is an exploded drawing, showing the various component of the trim securement system just prior to the assembly thereof.

FIG. 3 is a cross sectional view which details installation of the trim device 30 and complementary components. As illustrated in FIG. 3, sheeting 40 extends vertically on the building 10, as does the rake board 16. The rake board 16 has a rake board top 16T, a rake board bottom 16B, and a rake board front 16F. The rake-board J-channel 18R is nailed to the sheeting 40 immediately below the rake board 16. The rake-board J-channel 18R has a rear surface 41, a top surface 42, and a downwardly extending hook 43 which extends downward from the top surface 42 and parallel to the rear surface 41. The downwardly extending hook 43 creates a gap 44, between the downwardly extending hook 43 and the rear surface 41. The rear surface 41 of the rake-board J-channel 18R is nailed to the sheeting 18R with the top surface 42 abutting the rake board bottom 16B. The siding 14 is tucked into the gap 44.

A receiver molding 50 is attached to the rake board 16 at the rake board top 16T. The receiver molding 50 includes a vertical portion 51 and a horizontal U-shaped portion 52 which extends generally perpendicular to the vertical portion 51. The vertical portion 51 is nailed to the rake board front 16F near the rake board top 16T, while the horizontal U-shaped portion 52 extends on the rake board top 16T rearward from the rake board front 16F. The U-shaped portion 52 is tucked under the roofing tiles 12T, such that the roofing tiles 12T extend over the horizontal U-shaped portion 52, concealing the same.

The U-shaped portion 52 has a return 53 which is on an opposite end of the U-shaped portion from the vertical portion 51. The return 53 comprises a substantially one hundred eighty degree bend inward, inside the U-shaped portion 52.

The trim device 30 is adapted to cover the rake board face 16F, while extending into both the horizontal U-shaped portion 52 of the receiver molding 50 and the gap 44 of the rake-board J-channel 18R.

Also illustrated in FIG. 3, the trim device 30 has a front trim surface 30F, an upper trim surface 30U, and a lower trim surface 30L. Both the upper trim surface 3OU and the lower trim surface 30L extend perpendicular to the front trim surface 30F, and rearward therefrom. A trim tab 33 extends perpendicularly upward from the lower trim surface 30L, at an opposite end of the lower trim surface 30L from the front trim surface 30F. A catch 30UC extends upward from the upper trim surface 30U and forward therefrom, forming an acute angle therewith.

Installation of the trim device 30 completes the trim securement system. To install the trim device 30, the trim tab 33 is tucked upward into the gap 44 of the rake-board J-channel 18R, in front of the siding 14. The siding 14 generally exerts a spring force against the rake-board J-channel 18R. Thus, the siding 14 biases the tab 33 against the downwardly extending hook 43 of the rake-board J-channel 18R. The upper trim surface 30U is then inserted into the horizontal U-shaped portion 52 of the receiver molding 50. To secure the trim device 30, the catch 30UC is urged past the return 53, wherein the catch 30UC then becomes caught within the return 53, which prevents the upper trim surface 30U from being removed from the horizontal U-shaped portion 52. The trim device 30 is thereby held in place by a combination of the rake-board J-channel and the receiver molding 50.

Figure 2:
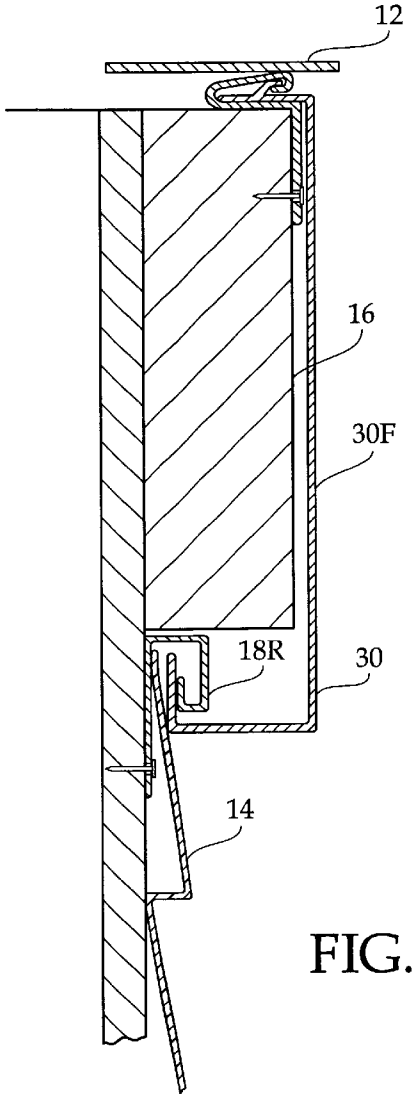
FIG. 2 is a cross sectional view, taken generally in the direction of arrow 2—2 in FIG. 1, showing components of the trim securement system of the present invention in cooperative engagement.

Referring to FIG. 2, the trim device 30 is shown in place, fully installed. The front trim surface 30F extends fully over both the rake board 16 and the rake-board J-channel 18R. Accordingly, the rake board 16 and rake-board J-channel are fully concealed, as are any nail holes in the rake board, proving a seamless appearance. Further, the trim device 30 ensures continuous waterproofing between the roof 12 and the siding 14.

In conclusion, herein is presented a trim securement system which provides an effective waterproofing and fascia solution at the roof-line of a building, wherein the rake-board J-channel and the rake board are fully covered and concealed by a seamless one piece trim device.

What is claimed is:

1. A trim securement method, for use on a building having a roof comprising roofing tiles, siding, a rake board between the roof and siding, and a rake-board J-channel located immediately below the rake board for securing the siding, using a trim device having a front trim surface sized to cover the rake board, upper and lower trim surfaces which extend perpendicularly rearward from the front trim surface, and a tab which extends perpendicularly upward from the lower trim surface, comprising the steps of:

inserting the tab into the rake-board J-channel;

extending the front trim surface over the rake board; and inserting the upper trim surface above the rake board, between the rake board and roofing tiles.

2. The trim securement method as recited in claim 1, wherein the rake board has a rake board top and a rake board front, wherein the method as recited further employs a receiver molding having a vertical portion and a horizontal U-shaped portion, wherein the step of inserting the upper trim surface above the rake board further comprises inserting the upper trim surface into the horizontal U-shaped portion of the receiver molding.

3. The trim securement method as recited in claim 2, wherein the steps of inserting the upper trim surface is preceded by mounting the receiver molding to the rake board front near the rake board top such that the horizontal U-shaped portion extends between the rake board top and the roofing tiles.

4. The trim securement method as recited in claim 3, wherein the upper trim surface comprises a catch extending upward and forward therefrom, the horizontal U-shaped portion comprises a return located fully opposite from the vertical portion making a substantially one hundred eighty degree bend, and wherein the step of inserting the upper trim surface into the horizontal U-shaped portion of the receiver molding further comprises trapping the upper trim surface in the receiver molding by catching the catch by the return of the horizontal U-shaped portion.

* * * * *